US009803642B2

(12) United States Patent
Heaps et al.

(10) Patent No.: US 9,803,642 B2
(45) Date of Patent: Oct. 31, 2017

(54) VACUUM PUMP WITH ECCENTRICALLY DRIVEN VANE (ECCENTRIC PUMP DESIGN)

(71) Applicant: WABCO Europe BVBA, Brussels (CH)

(72) Inventors: David Heaps, Haworth (GB); Simon Warner, Pontefract (GB)

(73) Assignee: WABCO EUROPE BVBA, Brussels (BE)

( * ) Notice: Subject to any disclaimer, the term of this patent is extended or adjusted under 35 U.S.C. 154(b) by 0 days.

(21) Appl. No.: 15/324,269

(22) PCT Filed: Aug. 7, 2015

(86) PCT No.: PCT/EP2015/001632
§ 371 (c)(1),
(2) Date: Jan. 6, 2017

(87) PCT Pub. No.: WO2016/026556
PCT Pub. Date: Feb. 25, 2016

(65) Prior Publication Data

US 2017/0198695 A1 Jul. 13, 2017

(30) Foreign Application Priority Data

Aug. 22, 2014 (EP) ..... 14002924

(51) Int. Cl.
*F03C 2/00* (2006.01)
*F03C 4/00* (2006.01)
(Continued)

(52) U.S. Cl.
CPC ..... *F04C 27/003* (2013.01); *F01C 21/0836* (2013.01); *F04C 18/3441* (2013.01);
(Continued)

(58) Field of Classification Search
CPC ..... F04C 27/003; F04C 18/3441; F04C 15/0065; F04C 25/02; F04C 29/0057;
(Continued)

(56) References Cited

U.S. PATENT DOCUMENTS 2,321,498 A * 6/1943 Madlem ..... F01C 21/0836 418/254
2,437,653 A * 3/1948 Rich ..... F04C 18/3441 418/255
3,204,563 A * 9/1965 Eickemeyer ..... F04C 18/3441 418/255

FOREIGN PATENT DOCUMENTS

DE 4020087 A1 1/1992
EP 0465807 A2 1/1992
(Continued)

*Primary Examiner* — Theresa Trieu
(74) *Attorney, Agent, or Firm* — Leydig, Voit & Mayer, Ltd.

(57) ABSTRACT

A rotating vane vacuum pump includes a housing defining a cavity having an inlet and an outlet, a drivable vane member for a rotary driven movement inside the cavity, a rotor inside the cavity, and a rotatable central shaft extending into the cavity. The vane member is coupled to the central shaft by an eccentric element on the central shaft and movably arranged in the rotor, the rotor being rotatable together with said vane member upon rotation of the vane member. A rotational axis of the central shaft is offset from a rotational axis of the rotor and a point of action of the vane member is offset from the rotational axis of the central shaft by the eccentric element on the central shaft. The rotor encloses radially the eccentric element of the central shaft.

21 Claims, 12 Drawing Sheets

(51) Int. Cl.

| | |
|---|---|
| ***F04C 2/00*** | (2006.01) |
| ***F04C 27/00*** | (2006.01) |
| ***F04C 18/344*** | (2006.01) |
| ***F04C 25/02*** | (2006.01) |
| ***F04C 29/00*** | (2006.01) |
| ***F01C 21/08*** | (2006.01) |

(52) U.S. Cl.
CPC ..... *F04C 25/02* (2013.01); *F04C 29/0085* (2013.01); *F04C 2220/10* (2013.01); *F04C 2240/20* (2013.01); *F04C 2240/50* (2013.01)

(58) Field of Classification Search
CPC ..... F04C 29/0085; F04C 2240/20; F04C 2240/50; F04C 2220/10; F01C 21/0809; F01C 21/0836
USPC ..... 418/253–255, 257–259
See application file for complete search history.

(56) References Cited

FOREIGN PATENT DOCUMENTS

| | | | |
|---|---|---|---|
| EP | 2024641 | B1 | 10/2009 |
| EP | 2249040 | A2 | 11/2010 |
| GB | 338546 | A | 11/1930 |
| JP | S 60206995 | A | 10/1985 |
| JP | 2000018183 | A | 1/2000 |
| WO | WO 2009052929 | A1 | 4/2009 |

* cited by examiner

VACUUM PUMP WITH ECCENTRICALLY DRIVEN VANE (ECCENTRIC PUMP DESIGN)

CROSS REFERENCE TO RELATED APPLICATIONS

This application is a U.S. National Stage Application under 35 U.S.C. §371 of International Application No. PCT/EP2015/001632 filed on Aug. 7, 2015, and claims benefit to European Patent Application Nos. EP 14002924.0 filed on Aug. 22, 2014. The International Application was published in English on Feb. 25, 2016 as WO 2016/026556 A1 under PCT Article 21(2).

FIELD

The invention relates to vacuum pumps, and more particularly to rotating vane vacuum pumps.

BACKGROUND

Vacuum pumps may be fitted to road vehicles with gasoline or diesel engines. Typically, the vacuum pump is driven by a camshaft of the engine, an electric motor or a belt drive. Rotating vane vacuum pumps typically comprise a housing defining a cavity having an inlet and an outlet and a drivable vane member for rotary driven movement inside the cavity. The housing may include a cover which closes the cavity. The drivable vane member is typically movable to draw fluid into the cavity through the inlet and out of the cavity through the outlet so as to induce a reduction in pressure at the inlet. The inlet is connectable to a consumer such as a break booster or the like.

In most vacuum pumps which are of the vane pump type, the rotor is driven and comprises a radially arranged slot in which the vane may freely slide and the vane is further guided by the cavity walls. A comparable vane pump is for example disclosed in EP 2 024 641. Such vane pumps are also called mono vane pumps since they incorporate one single vane which is slidable in a radial direction of rotor.

Further, vacuum pumps having multiple vanes which are separately guided and supported on a supporting surface are also know, as for example shown in DE 40 20 087. Such vacuum pumps have the disadvantage that they incorporate multiple individual parts and multiple friction surfaces which makes it difficult to seal them against the environment to effectively induce a vacuum inside the cavity.

From the WO 2009/052929 a vacuum pump is known comprising a housing defining a cavity having an inlet and an outlet, a drivable vane member for a rotary driven movement inside the cavity and a rotor inside the cavity. The vane is arranged in a radial slot of the rotor. Further the vacuum pump comprises an excenter shaft with a stroke pin which is coupled to the vane. The rotary axis of the excenter shaft is offset from the rotary axis of the rotor and the rotary axis of the stroke pin is offset from the rotary axis of the excenter shaft. The vane is guided by means of the excenter shaft and the stroke pin. In general the movement principal of such a vacuum pump is comparable to the principle of rotary piston pumps, as for example described in GB 338, 546.

SUMMARY

In an embodiment, the present invention provides a rotating vane vacuum pump. The rotating vane vacuum pump includes a housing defining a cavity having an inlet and an outlet, a drivable vane member for a rotary driven movement inside the cavity, a rotor inside the cavity, and a rotatable central shaft extending into the cavity. The vane member is coupled to the central shaft by an eccentric element on the central shaft and movably arranged in the rotor, the rotor being rotatable together with said vane member upon rotation of the vane member. A rotational axis of the central shaft is offset from a rotational axis of the rotor and a point of action of the vane member is offset from the rotational axis of the central shaft by the eccentric element on the central shaft. The rotor encloses radially the eccentric element of the central shaft.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
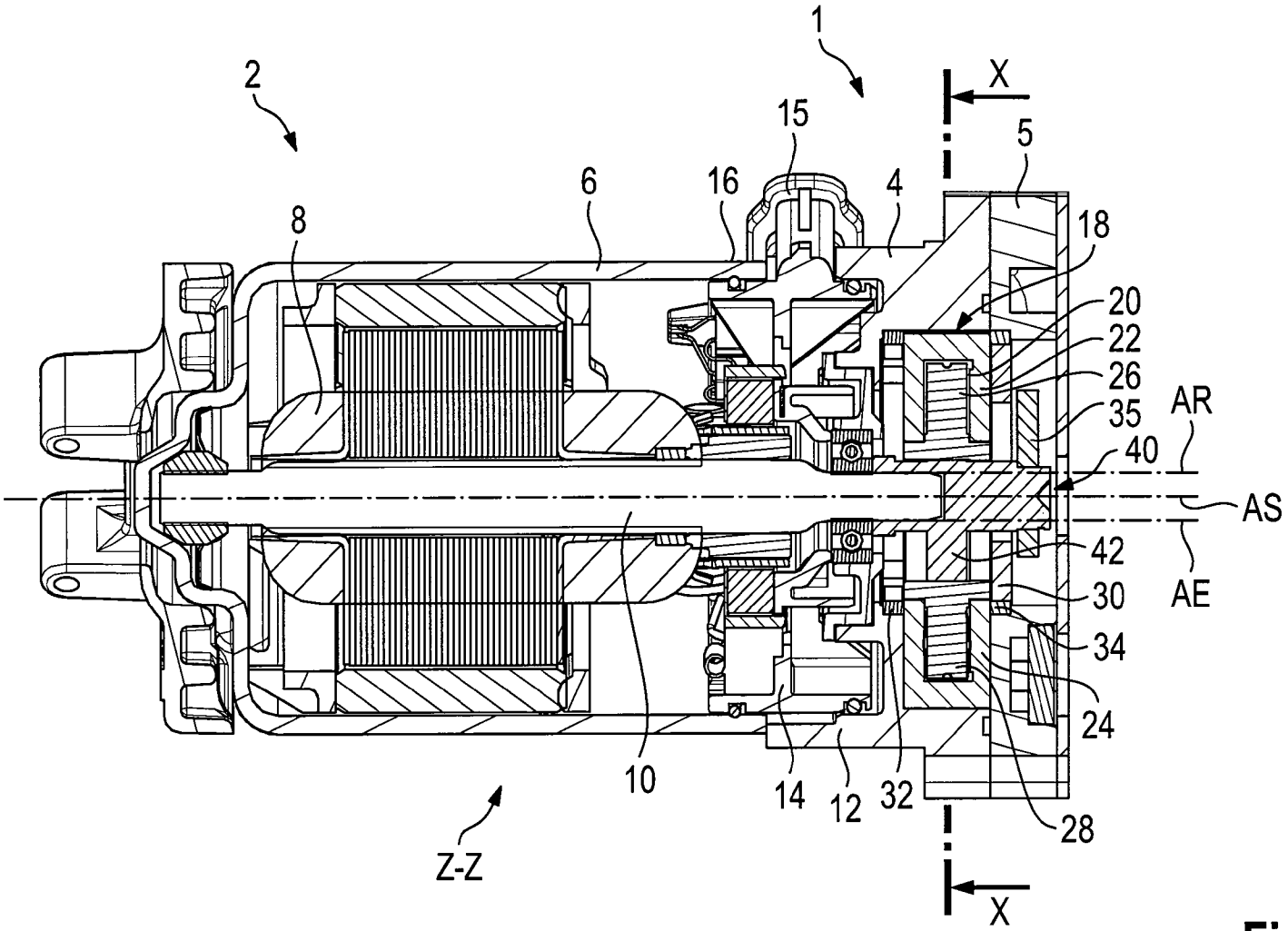
FIG. 1 shows a cross-sectional view of a vacuum pump according to an embodiment of the present invention.

Sealing of the cavity of a rotating vane vacuum pump against the environment to achieve an effective generation of a vacuum can be problematic. A rotating vane vacuum pump is described herein that enhances the sealing of the cavity against the environment and is able to effectively induce a vacuum inside the cavity.

In an embodiment of the present invention, a rotor is preferably arranged at a fixed location inside the cavity and only rotatable about its rotational axis. The rotatable central shaft extending into the cavity does not necessarily extend through the geometrical center of the cavity, much more it is sufficient and in accordance with the invention when the central shaft extends through a more or less central portion of the cavity with the rotational axis of the central shaft being offset from the rotational axis of the rotor. On the central shaft an eccentric element is provided which is offset from the rotational axis of the central shaft. This means that a main axis, a central axis, a rotational axis or a point of engagement from the eccentric element is offset of the rotational axis of the central shaft. The vane member is coupled to the central shaft by means of the eccentric element so that the vane member is drivable upon rotation of the central shaft or the central shaft is drivable upon rotation of the rotor, driving the vane in the alternative. The coupling between the central shaft and the vane member defined the point of action about which the force is transmitted from the central shaft to the vane member or vice versa.

In an embodiment of the invention, the rotor encloses radially the eccentric element of the central shaft. In other words, the eccentric element is packed within the rotor. In rotation, the eccentric elements moves back and forth relative to the rotor, since the rotational axis of the central shaft is offset from the rotational axis of the rotor and the eccentric element is eccentrically provided on the central shaft. When the rotor encloses radially the eccentric element, the rotor also encloses radially the central shaft. Therefore also a passage through which the central shaft extends into the cavity is radially enclosed by the rotor. Thus, it is sufficient to seal the rotor against the cavity and no additional gaps, slots or passages for the central shaft are present in the cavity defined between the rotor and the circumferential inner wall formed by the housing of the cavity. Due to the fact that the eccentric element is radially enclosed by the rotor, the eccentric element does not move "outside" the rotor upon rotation of the central shaft and the rotor. Therefore additional sealing points can be omitted and the overall sealing of the vacuum pump is enhanced.

According to a first preferred embodiment the rotor comprises a substantially cylindrical outer wall and defines an inner space, wherein said eccentric element of the central shaft moves back and forth in a radial direction of the rotor when the central shaft is in rotation. Thus, the eccentric element, the central shaft and also the coupling between the eccentric elements and the vane member are arranged inside the inner space of the rotor and therefore packed within the rotor.

The outer wall of the rotor may comprise any suitable shape. Preferably the outer wall of the rotor has a substantially cylindrical shape. This leads to a simpler sealing arrangement. Preferably the housing defining the cavity comprises a substantially flat bottom surface and a substantially a flat top surface and a circumferential wall connecting the bottom and the top surfaces. The bottom surface is preferably formed by a bottom plate which may be integral with the casing. The top surface is preferably formed by an end plate which may be a cover plate. The rotor preferably extends from the bottom surface to the top surface and is sealed against the same. Due to the fact that the eccentric element of the central shaft moves back and forth in a radial direction of the rotor and is arranged in the inner space of the rotor, only the rotor needs to be sealed against the bottom surface and the top surface thus providing an enhanced sealing arrangement of the vacuum pump.

Further it is preferred that the inner space of the rotor has an inner diameter which is at least twice the maximum offset of the central axis of the eccentric element and the rotational axis of the rotor. The maximum offset of the central axis of the eccentric element and the rotational axis of the rotor can also be interpreted as the maximum stroke of the eccentric element relative to the fixed rotational axis of the rotor. Thus, when the inner space of the rotor has an inner diameter according to this embodiment, it is ensured that the eccentric element and thus the coupling between the vane member and the eccentric element is permanently arranged inside the rotor and no additional connecting points which need to be sealed are present inside the cavity. This further leads to an improved sealing of the vacuum pump and to an effective generation of vacuum.

According to a further preferred embodiment the rotor wall comprises first and second slots in first and second opposing positions on a radial direction, such that the vane member is slidable in the radial direction of the rotor when the central shaft and/or the rotor is in rotation. The first and second slots form guides for the vane member. Preferably the vane member is only coupled to the rotor by means of these slots. The vane member is preferably sealed against the rotor at these slots, for example by means of a close relationship or additional sealing means such as elastomeric or rubber lips or the like.

Particularly preferred, the central shaft, the rotor and the vane member are positively coupled together. Thus, the three main moving parts, namely the central shaft, on which the eccentric element is provided, the rotor and the vane member always have a geometrically defined relationship to each other. Therefore it is possible to drive and move the vane member based only on the positive coupling between the central shaft, the rotor and the vane member and it is not necessary to guide the vane member by means of the inner circumferential wall of the cavity. Thus the vane member does not necessarily touch the wall. Therefore frictional losses of the vacuum pump can be omitted. Furthermore it becomes possible to improve the sealing between the vane member and the inner circumferential wall of the cavity since the vane member is not guided by the wall leading to a reduction of losses between the vane member and the inner circumferential wall.

According to a further preferred embodiment the central shaft rotates twice the rotational angle of the rational angle of the vane member and rotor. Thus, when for example the central shaft rotates about an angle of 180°, the vane member and the rotor rotate about an angle of 90°. Therefore the central shaft rotates twice as fast as the rotor and the vane member. This transmission between the central shaft and the rotor occurs due to the specific coupling of the parts and the geometrical properties which define that the vane member is coupled to the central shaft by means of the eccentric element on the central shaft and the rotational axis of the central shaft is offset from the rotational axis of the rotor and the point of action of the vane member is offset from the rotational axis of the central shaft by means of the eccentric element on the central shaft. Thus it becomes possible to rotate the rotor and the vane at half the speed of the central shaft. This may be beneficial when for example the central shaft is driven by means of an electric motor having an high output speed. In many applications a slower rotation of the vane member is sufficient to provide a desired vacuum. Incorporating the transmission between the central shaft which may form the drive shaft and the vane member leads to a reduction in loads and stresses on the moving parts of the vacuum pump which enhances the lifetime of the vacuum pump. On the other hand it is also possible to use the rotor as a drive element and directly couple the rotor to an electric motor or a belt drive or the like. In this case the vane member rotates at the output speed of the drive motor and thus in a manner as a common vacuum pump of the state of the art does. Thus, the vacuum pump of the present invention can be used in both applications with or without transmission and according to the specific requirements of the specific use case.

In a further preferred embodiment of the vacuum pump, the radially outermost point of the eccentric element relative to the central shaft is located at: (a) in a first rotational position on a longitudinal plane of the vane member; and (b) in a second rotational position distal from the longitudinal plane of the vane member; wherein in the first rotational position only one tip of the vane member projects out of the rotor and in the second rotational position both tips project substantially the same distance from the rotor. Preferably a third rotational position corresponds again to the first rotational position and a forth rotational position corresponds to the second rotational position. As described above, the eccentric element preferably moves in a stroke-like manner inside the rotor back and forth in a radial direction when the rotor is in rotation. Therefore, since the vane member is engaging the eccentric element, also the vane member is moved in a stroke-like manner relative to the rotor. In other words, the eccentric elements acts like a crank for the vane member. The vane member is moved in the radial direction of the rotor by means of the strokes of the eccentric elements cranking the vane member so that the variable working chambers inside the cavity of the vacuum vane pump are effected.

According to such an embodiment it is further preferred that the direction of the driving force at the point of force application between the eccentric element and the vane member is: (a) in the first rotational position substantially perpendicular to the plane of the vane member; and (b) in the second rotational position substantially parallel to the plane of the vane member. Thus, when described with relationship to an embodiment where the central shaft is used as a drive shaft, in the first rotational position in which only one tip of a vane of the vane member projects out of the rotor, the direction of the driving force is tangential relative to the rotor and the force transmission from the vane member to the rotor is at a maximum value; the movement speed of the vane member in the radial direction of the rotor is equal to zero. In the second rotational position, in which both tips of the vane member project substantially the same distance from the rotor, the direction of the driving force at the point of force application is substantially parallel to the plane of the vane member and thus the force transmission from the vane member to the rotor is at a minimum value and at the same time the movement speed of the vane member in the radial direction of the rotor is at a maximum value.

According to a further particular preferred embodiment the eccentric element is formed as a cam on the central shaft and the vane member comprises a central hollow jacket and the vane member is seated about the cam by means of the jacket. Preferably the cam forming the eccentric element has a substantially cylindrical shape having a circular cross-section. Preferably the cam forming the eccentric element has a larger diameter than the central shaft. Thus, the contacting surface between the eccentric element and the hollow jacket of the vane member is increased leading to an improved force transmission between the single parts. Additionally such an arrangement leads to a stable and substantially stiff arrangement of the parts which again leads to an improved sealing of the vacuum pump and an effective vacuum generation. According to such an embodiment the central axis of the cam is identical to the point of action of the vane member.

Particularly preferred is the vane member formed as a single one-piece vane member having first and second vanes on the hollow jacket protruding in a radial direction on opposing sides of the jacket. On the one hand such a vane member is easy to manufacture. On the other hand when the vane member is formed as a single one-piece, no connection points between the vanes and the hollow jacket are needed leading to a stiffer and more stable construction of the vane member which again is beneficial for the sealing of the vacuum pump against the environment.

In a further preferred embodiment of this type the cam extends along the central shaft from a first axial position to a second axial position and both of the first and second positions are located within the cavity. Preferably both of the first and second positions are located within the rotor as well. Thus the whole eccentric element is arranged within the cavity and preferably within the rotor which leads to improved sealing. The eccentric element moves like a crank or in strokes relative to the rotor and thus due to the fact that this element is completely encased within the cavity and preferably within the rotor, only the central shaft extending into the cavity may be provided with a seal but not the eccentric element itself.

According to a further preferred embodiment the central shaft extends through the rotor and preferably through the cavity such that end portions of the central shaft project from opposing sides of the rotor and preferably of the cavity. Preferably the central shaft extends through the bottom surface and the top surface of the cavity. Preferably at least one bearing for the central shaft is provided at the bottom portion of the cavity and at least one bearing for the central shaft is provided at the top portion of the cavity. Thus the central shaft can be seated in bearings on both opposing sides of the eccentric element and forces generated due to the movement of the eccentric element and the vane member can be transmitted into the housing. This leads to a stable and stiff construction and sealing may be further enhanced.

Further it is preferred that the offset of the rotational axis of the central shaft relative to the rotational axis of the rotor is substantially identical to the offset of the point of action of the vane member relative to the rotational axis of the central shaft. This leads to a suitable matching of the moving parts and provide a proper movement.

According to a particular preferred embodiment the rotor comprises at least one bearing journal for bearing the rotor against a bottom plate and/or an end plate of the cavity. The bottom plate preferably forms the bottom surface of the cavity and the end plate preferably forms the top surface of the cavity. In general the bottom plate may be integrally formed with the housing. The end plate may be separate from the housing and formed as a cover which is fixed via screws or the like to the housing. The bearing journals are preferably formed as ring or ring segment shaped protrusions coaxially arranged with the rotational axis of the rotor. Such bearing journals are easy to manufacture and provide for a stable bearing of the rotor even during high rotational speeds. Alternatively the bearing journal is formed as at least two ring segments provided as protrusions on axial ends of the rotor. For example the ring segments can be arranged in such a way that the slots for the vane member are kept open, so that mounting the vane member to the rotor is possible in a simple and easy way.

For such an embodiment is further preferred that the bearing journal is received in a bearing in the bottom plate and/or the end plate. Such a bearing may be formed as a roller or a needle bearing. Particular preferred is the bearing formed as a friction bearing, in particular a dry friction bearing. Such bearings may incorporate dry friction materials such as PEEK and on the one hand provide sharp tolerances for the bearing journal and thus for the rotor being received in the bearing and on the other hand serve at the same time as a sealing mean for the rotor against the bottom and/or end plate.

According to another preferred embodiment a vane member tip, in particular first and second tips of first and second vanes at first and second ends of the vane member, are moved with a distance remaining between the tip and an inner circumferential wall of the cavity along this inner circumferential wall of the cavity. Thus, the tips are moved in a non-contact manner along the inner circumferential wall of the cavity. Therefore, no friction between the vane tip and the inner circumferential wall occurs, which leads to a reduced wear and further enhances the efficiency. Preferably the distance is kept constant over the whole length. Preferably the distance is in the range of close to zero and 1.5 mm, in particular 1 mm or less, more particular 0.8 mm, 0.6 mm, 0.5 mm, 0.3 mm, 0.2 mm. It is also possible and preferred to enlarge or reduce the distance at specific points of the inner circumferential wall. Thus, load on the vane and vane tip during rotation dependent on specific rotational positions of the vane member can be controlled.

The inner circumferential wall of the cavity has preferably in a cross-section perpendicular to the rotational axis of the rotor a non-circular, in particular a conchoid of a circle form. A conchoid shape goes well together with the particular described movement of the vane, the eccentric element and the rotor when these are positively coupled together in the above described manner. If the parts are positively coupled together in this manner, the tips of the vanes in rotation describe a conchoid of a circle and thus, if the inner circumferential wall of the cavity is formed accordingly, a constant gap of e.g. 0.8 mm between the vane tip and the inner circumferential wall can be incorporated.

In a further embodiment the rotor is sealed in a substantially fluid tight manner against a bottom plate and/or an end plate of the cavity. In case the rotor comprises bearing journals received in bearings in the end plate and bottom plate, a friction bearing is provided which at the same time serves as sealing means according to the present embodiment. However it is also possible and preferred in the same way to incorporate additional sealing means as for example O-rings, radial shaft sealing rings, or other suitable sealing elements.

According to a further preferred embodiment vane member tips and/or first and second side portions of the vane member comprise sealing means for sealing the vane member against the cavity. Therefore in one alternative the sealing means are only provided at the vane member tips, thus between vane and the inner circumferential wall of the cavity. In an alternative only first and second side portions of the vane member, thus the portions of the vane member which are adjacent to the bottom and the end plate respectively are provided with sealing means. In a further alternative the vane member tip and the side portions are provided with sealing means. Such sealing means are used to contact the inner circumferential wall and/or bottom and end plate for sealing the vane member preferably in a fluid tight manner against the inner circumferential wall and/or bottom or end plate and to preferably fluid tight separate the working chambers formed inside the cavity and divided by the vanes of the vane member. Such sealing means are used to increase the effectivity of vacuum generation inside the vacuum pump.

In a first development the sealing means are at least arranged at three sides of the vane member and comprise a pressure deforming seal having a lip in contact with the cavity wall and bent into the direction of rotation of the vane member. The at least three sides preferably are the above mentioned side portions and the vane tip, thus the sealing means are arranged between the vane and the bottom plate, the end plate, and the inner circumferential wall. The lip of the pressure deforming seal is bent into the direction of rotation of the vane member and therefore forms at least partially a cavity between the lip and the vane member. Therefore fluid which is forced out of the cavity by means of the rotating vane member enters the cavity between lip and vane member and additionally presses the lip against the cavity wall. This leads to a tight and effective sealing. In particular in combination with the tip traveling with a constant distance from the inner circumferential wall of the cavity this particular type of sealing means is preferred, since no forces due to guidance of the vane along the inner circumferential wall act upon the sealing means and the lip, but only the elastic pressure of the lip itself and the additional pressure of the fluid pressed out of the cavity by rotation of the vane act on the lip and forces the lip against the cavity wall. Therefore, such a sealing means is adaptive and the lip is pressed harder against the wall when the pressure inside the cavity arises and pressed in a lighter way, when the pressure inside the cavity is reduced.

In a preferred alternative the sealing means comprise a floating seal arranged partially in a recess at the tip and/or the first and second side portions of the vane. The floating seal for example may be formed as a strip of elastomeric material or rubber material being arranged at least partially in the recess. The floating seal is not fixed to the vane by any adhering material or the like but is much more only seated in the recess so it can move in the direction of the plane of the vane member. Thus, when a rotational speed of the vane member increases, the centrifugal force forces the floating seal to move slightly out of the recess and to contact the inner circumferential wall more tightly providing a tighter seal. Thus, such a floating seal can provide an adaptive sealing performance dependent on the rotational speed of the vane member. Additionally, even when wear occurs on a tip of the floating seal, the floating seal is able to contact the inner circumferential wall due to the relative movement.

In a further, third alternative, the sealing means preferably comprise a pressure activated seal, wherein a sealing element is at least partially arranged in a recess at the tip and/or the first and second side portions of the vane member and the recess is in communication with a pressure gallery formed in the vane. The general arrangement of such a pressure activated seal is comparable to the arrangement of the floating seal. However, different from the floating seal, according to the pressure activated seal the recess or groove, in which the sealing element is arranged, is connected with a pressure gallery. Such a pressure gallery may be formed as a conduit connecting a front face i.e. the surface of the vane which faces into the direction of movement, with the inner portion of the recess so as to additionally force the sealing means out of the recess and into contact with the cavity wall, when the pressure inside the cavity arises. Therefore, such a sealing arrangement adjusts the sealing tightness dependent on the pressure inside the cavity.

Even though the three different concepts of sealing at the vane member have been described separately from each other a combination of two or three different concept is preferred as well. E.g. the floating seal may comprise a lip according to the pressure deforming seal. Alternatively at the tip of the vane a different concept is used compared to the side portions of the vane.

According to a further preferred embodiment of the vacuum pump, the central shaft is a drive shaft and coupled to a driving motor for driving the vacuum pump. Such a driving motor may be formed as any drive suitable for driving the vacuum pump, such as an electric motor directly coupled to the central shaft, an electric motor coupled via a belt drive to the central shaft, or the central shaft coupled to a shaft, e.g. a cam shaft, of a combustion engine. When the central shaft is a drive shaft and coupled to a driving motor, the above mentioned transmission of the rotational speed occurs. Thus, when the central shaft is a drive shaft, the vane member rotates at half the speed of the drive shaft. The rotor in such an arrangement is passive and only driven due to the coupling of the rotor to the vane member.

In an alternative the rotor is formed as a drive rotor and coupled to a driving motor for driving the vacuum pump. In this alternative only the rotor is driven and the central shaft is passive. As described above, in such an arrangement no transmission of the drive speed occurs and the rotor and also the vane rotate at the same speed as an output shaft of the driving motor. In such an arrangement it may be provided that the bearing journals of the rotor further extend from the rotor for forming a drive shaft which is integral with the rotor.

For a more complete understanding of the invention, the invention will now be described in detail with reference to the accompanying drawings. The detailed description will illustrate and describe what is considered as a preferred embodiment of the invention. It should of course be understood that various modifications and changes in form or detail could readily be made without departing from the spirit of the invention. It is therefore intended that the invention may not be limited to the exact form and detail shown and described herein, nor to anything less than the whole of the invention disclosed herein and as claimed hereinafter. Further the features described in the description, the drawing and the claims disclosing the invention may be essential for further developments of the invention considered alone or in combination. In particular, any reference signs in the claims shall not be construed as limiting the scope of the invention. The wording "comprising" does not exclude other elements or steps. The wording "a" or "an" does not exclude a plurality. The wording, "a number of" items, comprises also the number one, i.e. a single item, and further numbers like two, three, four and so forth.

According to FIG. 1 a vacuum pump 1 is connected with a drive motor 2 and the housing 4 of the vacuum pump 1 is integrally formed with the housing 6 of the drive motor 2. The drive motor 2 is according to this embodiment formed as an electric motor of the rotor stator type and the rotor 8 is coupled to a drive shaft 10. A cover 5 is fixed to the housing 4.

The housing 4 of the vacuum pump 1 is seated by means of a connection portion 12 on a frame 14 which includes the electrical connection 15 for the drive motor 2. The housing 6 of the drive motor 2 is seated by means of a connection portion 16 on the frame 14 as well. Thus, the housing 6 of the drive motor 2 and also the housing 4 of the vacuum pump 1 and thus the vacuum pump 1 itself, are detachable from the frame 14.

The housing 4 of the vacuum pump 1 further defines a cavity 18 which is at a distal end of the housing 4 relative to the motor 2 closed by the cover 5. The cavity 18 comprises an inlet and an outlet, which are not shown in FIG. 1. Inside the cavity 18 a drivable vane member 20 is provided for rotary driven movement inside the cavity 18. The vane member 20 is provided with a sealing means 22, 24, which is arranged around three sides of each vane 26, 28 (see also FIGS. 12-17).

The vacuum pump 1 further comprises a rotor 30 of which only a part can be seen in FIG. 1. The rotor 30 will be described in greater detail below with reference to FIG. 3 and FIG. 11 in particular. The rotor 30 is received in two bearings 32, 34 of which one bearing 32 is arranged at a bottom portion of the housing 4 and the other bearing 34 is received in the end plate of the cavity 18 formed by the cover 5.

Further with reference to FIG. 1, a rotatable central shaft 40 extending into the cavity 18 is provided for the vacuum pump 1. The central shaft 40 according to this embodiment is coupled to the drive shaft 10 of the electric drive motor 2 and therefore serves as a drive shaft. An eccentric element 42 is provided on the central shaft 40 and formed integrally with the latter one. The vane member 20 is coupled to the central shaft 40 by means of the eccentric element 42. In FIG. 1 further three axes AR, AS, AE are shown. AR indicates the rotational axis of the rotor, AS the rotational axis of the central shaft 40 and AE indicates the central axis of the eccentric elements 42 which in according to this embodiment is identical to the point of action of the vane member 20. As it can be derived from FIG. 1, the rotational axis AS of the central shaft 40 is offset from the rotational axis AR of the rotor and the axis AE defining the point of action of the vane member 40 is offset from the rotational axis AS of the central shaft 40.

Figure 5:
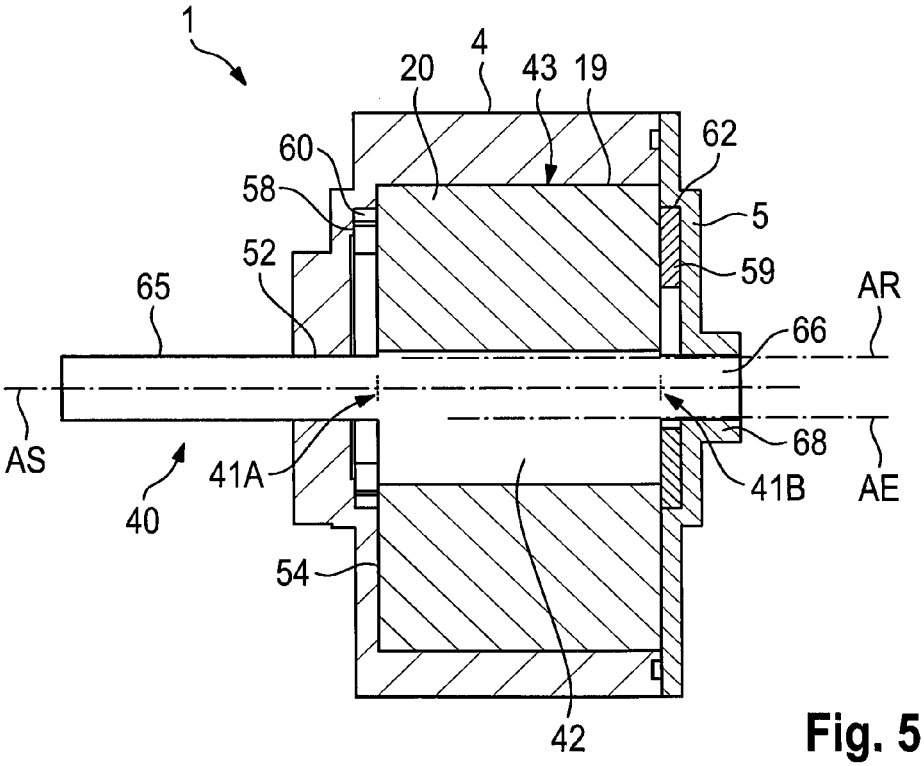
FIG. 5 shows a cross-sectional view of the vacuum pump of FIG. 4 along the line Z-Z.

According to the embodiment of FIG. 1 the central shaft 40 extends through the cavity 18 and protrudes from both opposing sides of the rotor 30 (see also FIG. 5). At an end portion of the central shaft 40 opposite to the drive motor 2 a counter weight 35 is provided for compensating the imbalance caused by the eccentric element 42 provided on the central shaft 40 when in rotation.

Figure 2:
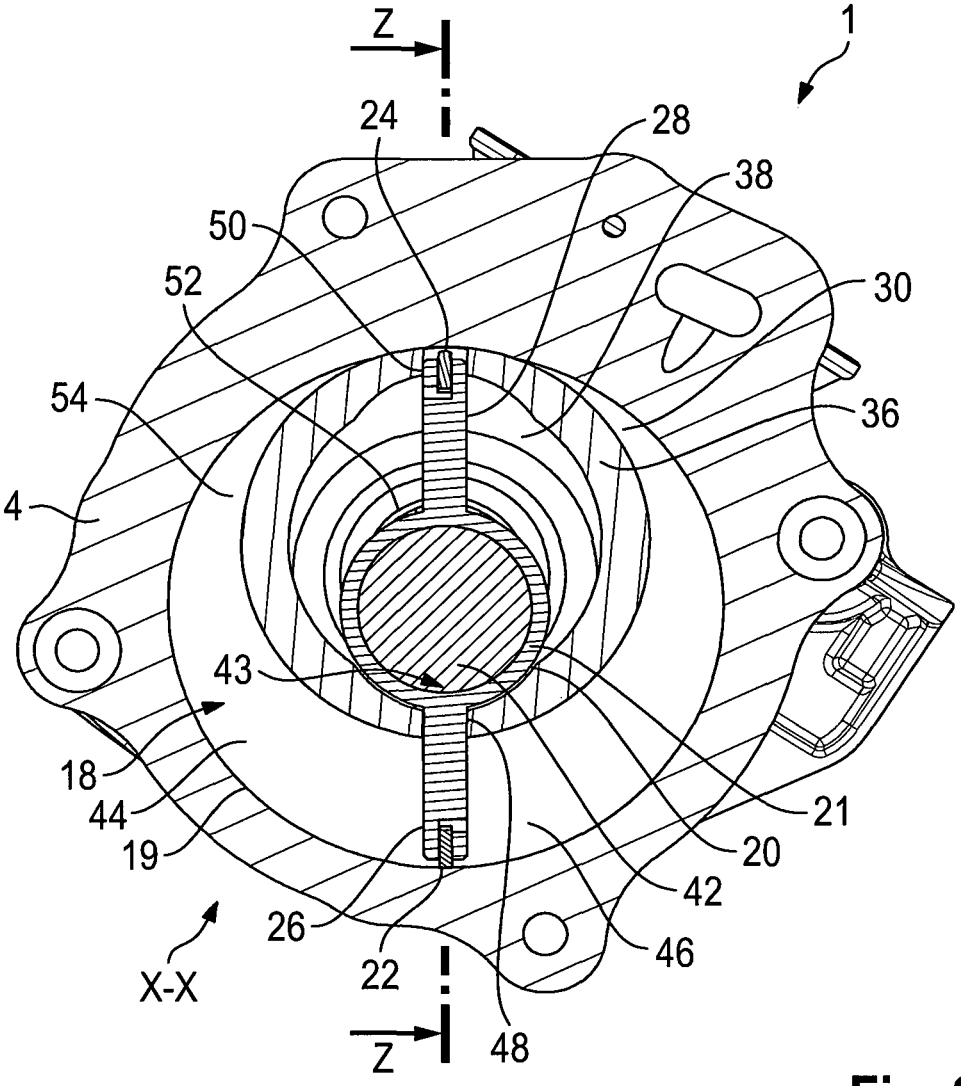
FIG. 2 shows a cross-sectional view of the vacuum pump of FIG. 1 along the line X-X

With reference to FIG. 2, which shows a cross-section of the vacuum pump 1 according to FIG. 1 along the cut X-X, the vacuum pump 1 includes a housing 4 which defines the cavity 18. The cavity 18 includes an inner circumferential wall 19. The cavity 18 is divided into two working chambers 44, 46 by means of the vane member 20. The vane member 20 (see also FIG. 3) is formed as a single one-piece member 20 having a central hollow jacket 21 from which two vanes 26, 28 protrude in opposing directions. The vanes 26, 28 are symmetrically shaped and have the same length measured in radial direction. By means of the central hollow jacket 21 the vane member 20 is coupled to the eccentric element 42 provided on the central shaft 40, which cannot be seen in FIG. 2. The rotor 30 is cut along the plane perpendicular to the rotational axis AR of the rotor (see FIG. 1). The rotor 30 comprises a rotor wall 36 which defines a substantially cylindrical outer shape. The rotor wall 36 further defines an inner space 38 in which the eccentric element 42 and therefore also the hollow jacket 21 of the vane member 20 and the central shaft (which cannot be seen in FIG. 2) are arranged. Thus the rotor 30 radially encloses the eccentric element 42 of the central shaft 40. Therefore the eccentric element 42 and also the coupling of the eccentric element 42 and the vane member 20 as well as the central shaft 40 are packed within the rotor 30. The radially outermost point of the eccentric element 42 is indicated with reference sign 43. It is the point having the maximum radial distance to the central axis AS of the central shaft 40.

The rotor 30 comprises two opposing slots 48, 50 through which the vanes 26, 28 extend out of the rotor 30 and the vane member 20 is thus movable in a radial direction relative to the rotor 30. By means of these slots 48, 50 the rotor 30 and the vane member 20 are coupled together for a common rotation.

As further can be seen from FIG. 2, the tips of the vanes 26, 28 are provided with sealing means 22, 24 which are in contact with the inner circumferential wall 19 of the cavity 18. The rotor 30 is provided at a side portion of the cavity 18 and thus the rotor wall 36 is at one point in a close relationship with the inner circumferential wall 19 of the cavity 18, as can be seen. According to FIG. 2, this contact point is the upper most position. The rotor 30 is positioned at a fixed location inside the cavity 18 and only rotatable about its rotational axis AR (see FIG. 1).

Due to the fact that the eccentric element 42 and the coupling between the eccentric element 42 and the hollow jacket 21 as well as the central shaft 40 itself are radially enclosed by the rotor 30 and thus packed inside the inner space 38, no connecting lines, slots or openings as for example the opening 52 for the central shaft 40 are present at the bottom plate 54 in the space between the rotor wall 36 and the inner circumferential wall 19 of the cavity 18 which could lead to a leakage when the respective vane 26, 28 moves over such a connection line, slot or opening in operation of the vacuum pump 1.

Figure 3:
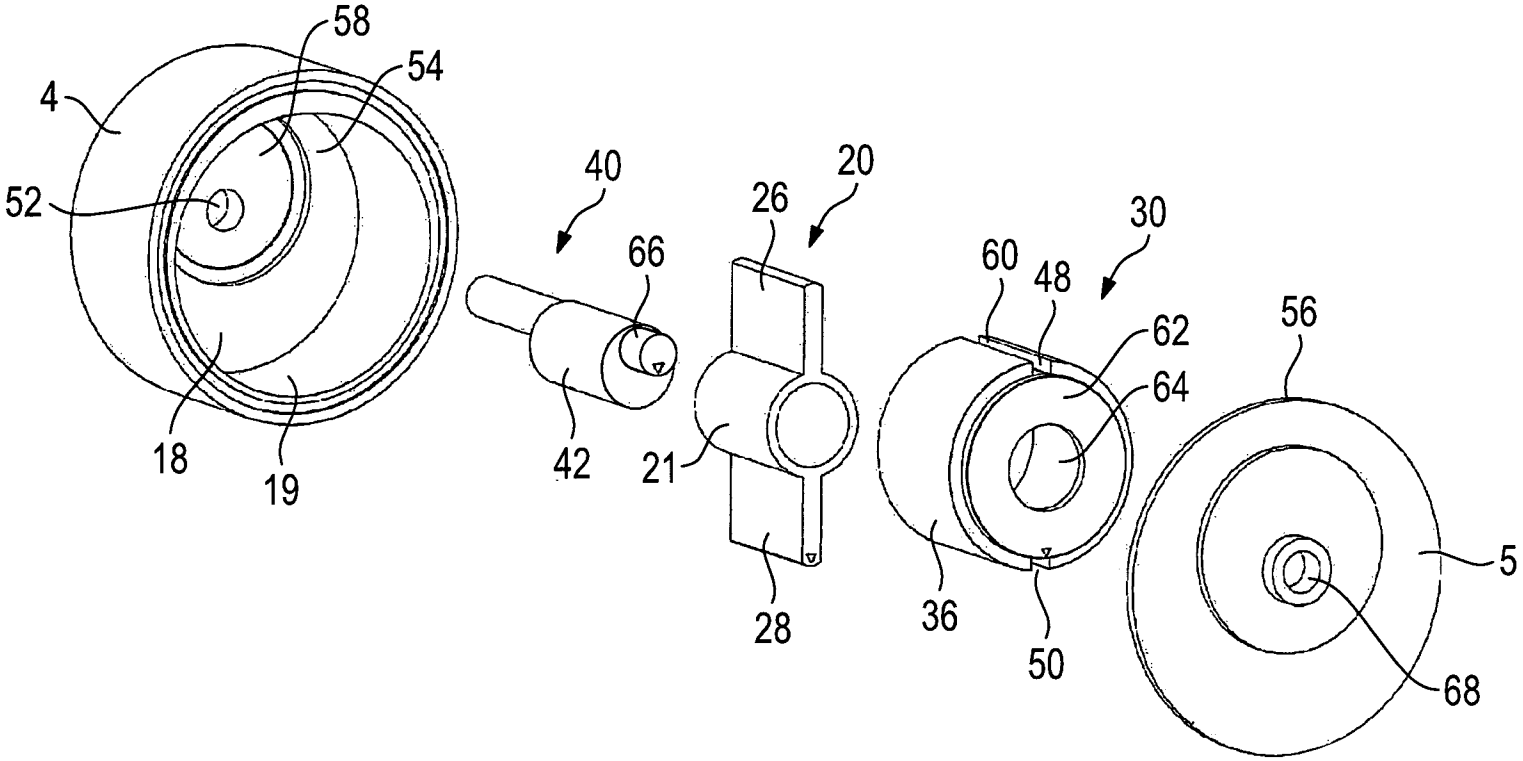
FIG. 3 shows a simplified exploded view of the vacuum pump according to an embodiment of the present invention.

With reference to FIG. 3, the assembly of the main moving parts of the vacuum pump 1 is illustrated. The housing 4 according to the illustration of FIG. 3 is only shown by means of an illustrating example and in praxis will have a different outer shape.

According to FIG. 3, the housing 4 defines the cavity 18 which has a inner circumferential wall 19. Integral with the housing 4 there is provided a bottom plate 54. The corresponding end plate 56 is provided at the back side relative to FIG. 3 of the cover 5. The bottom plate 54 comprises a circular recess 58 which is adapted for receiving a bearing 32 (see FIG. 1) and a bearing journal 60 of the rotor 30. Further inside the recessed portion 58 the opening 52 is provided through which the central shaft 40 extends into the cavity 18.

As can be derived from FIG. 3, the rotor 30 which comprises wall 36 surrounds and thus encloses the opening 52 to that sealing of the cavity 18 against the environment, is enhanced.

The rotor 30 includes beside the first bearing journal 60, which is adapted for engaging the recess 58, a second bearing journal 62, which is adapted to be received in a bearing 34 formed in the end plate 58. Thus, the rotor 30 may be received in a two opposed bearings 32, 34 so as to provide a stable arrangement and an effective sealing of the cavity 18. The rotor 30 further includes an opening 64 through which an end portion extension 66 of the central shaft 40 may protrudes and engage a bearing 68 formed in the cover 5. At this end portion 66 the counter weight 35 may be fixed.

Figure 4:
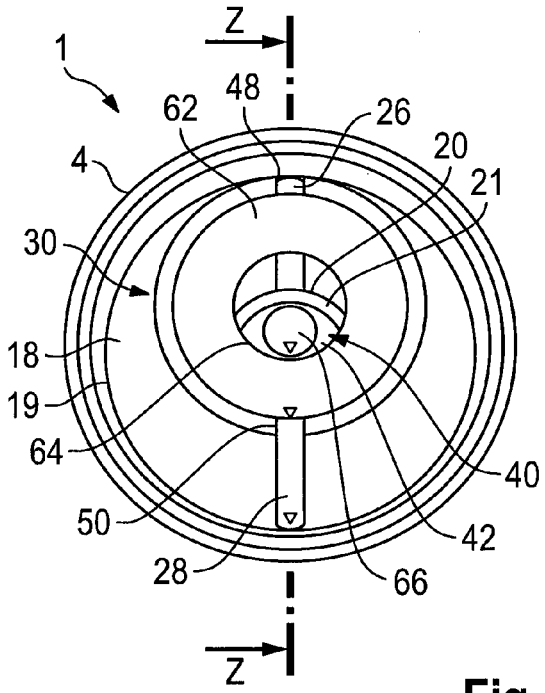
FIG. 4 shows a top view of the assembled vacuum pump according to FIG. 3.

FIG. 4 and FIG. 5 illustrate the vacuum pump 1 of FIG. 3 in an assembled condition. As it can be seen, the central shaft 40 extends through the cavity 18 in that a bottom portion 65 of the central shaft 40 extends through the opening 52 in the bottom plate 54 then a middle portion of the central shaft 40 runs through the hollow jacket 21 of the vane member 20 and the end portion 66 of the central shaft 40 protrudes into the cover 5 where it is received in a bearing 68. Therefore the central shaft 40 is received in the opening 52 and the bearing 68 on opposing sides of the cavity 18.

The eccentric element 42 is formed as a cam on the central shaft 40. According to this embodiment the central shaft 40 and the eccentric element 42 are integrally formed for example by means of casting, milling or turning from a block material. The cam extends along the central shaft 40 from a first axial position 41A to a second axial position 41B. Both, the central shaft 40 and the eccentric element 42 have circular cross sections and are generally formed as cylindrical shaft portions. The diameter of the eccentric element 42 is approximately twice of the diameter of the central shaft 40. As it can easily be seen from the conjunction of FIG. 3 to FIG. 5, the rotational axis AR of the rotor 30 is offset of the rotational axis AS of the central shaft 40 and the central axis AE of the eccentric element 42, which is the central axis AE of the cylindrical portion defined by the eccentric element 42, is offset of the rotational axis AS of the central shaft 40. Therefore, when the central shaft 40 rotates, the central axis AE of the eccentric element 42 rotates around the rotational axis AS of the central shaft 40.

The vane member 20 which is formed as a single one-piece vane member for example by means of casting or milling from a block material, is coupled to the central shaft 40 only by means of the hollow jacket 21, which is seated about the eccentric element 42. The inner diameter of the hollow jacket 21 substantially corresponds to the outer diameter of the eccentric element 42 and thus the vane member 20 is freely rotatable around the eccentric element 42, when coupled to the central shaft 40. Additionally, the vane member 20 is coupled to the rotor 30 in that the vanes 26, 28 are seated in the slots 48, 50 provided in the rotor 30. Both, the rotor 30 and the central shaft 40 are kept in fixed locations due to the fact that the rotor 60 is received by means of the bearing journals 60, 62 in the recessed portions 58, 59 and the central shaft 40 is received in the openings 52, 68. Thus all the moving parts, namely the rotor 30, the vane member 20, the central shaft 40 and the eccentric element 42 are positively coupled together and upon rotation of the central shaft 40 the rotor 30 is forced into rotation and vice versa as will be described in more detail with reference to FIG. 6*a* to FIG. 6*d*.

Figure 6D:
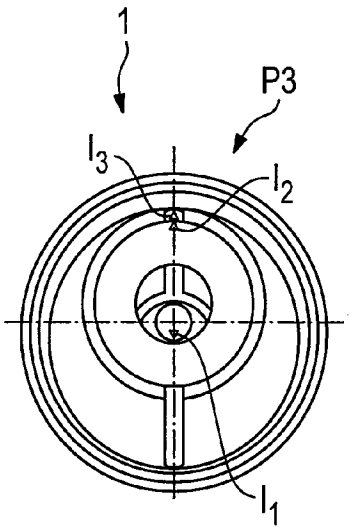
FIGS. 6*a*-6*d* illustrate different rotational positions of the vacuum pump of FIG. 4.
Figure 6C:
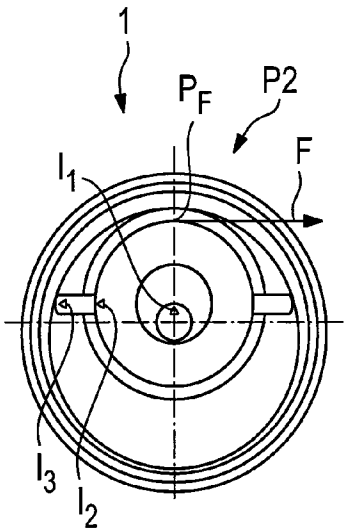
Figure 6B:
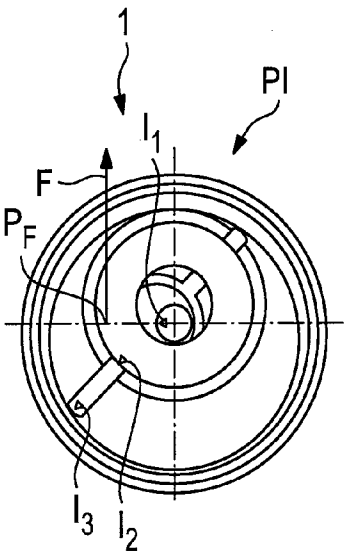

FIG. 6*a* to FIG. 6*d* illustrate the movement or the moving parts during an operation. It is shown how the rotor 30 rotates and how the vane member 20 moves upon one full rotation of the central shaft 30. The main parts are indicated with reference signs in FIG. 6*a*; in FIG. 6*b* to FIG. 6*d* these reference signs are left away to simplify the illustration. However it will be understand that FIG. 6*b* to FIG. 6*d* show the same parts as FIG. 6*a* however in different rotational position as now will be described.

The rotor 30, the central shaft 40 and the vane member 20 are provided with indicators I1, I2, I3 in the form of arrows for indicating a rotational position of these parts. According to FIG. 6*a* all three indicators I1, I2, I3 direct to the bottom of FIG. 6*a* and thus, compared to a watch all three indicators I1, I2, I3 direct to the six o'clock-position.

When now for example the central shaft 40 is rotated in a clockwise direction about 90° about its rotational axis AS (see also FIG. 5) the eccentric element 42 which is formed on the central shaft 40 is rotated about 90° as well as the central axis AE of the eccentric element 42 and thus the point of action of the eccentric element 42 moves on a circle segment about 90° from the six o'clock-position to the nine o'clock-position. Since the vane member 20 engages the eccentric element 42 in that the central hollow jacket 21 is seated about the eccentric elements 42, the point of action of the vane member 20 which is identical to the central axis AE of the eccentric element 42, is moved to the nine o'clock-position as well. However, since the vane member 20 is not freely movable but positively coupled to the rotor 30 by means of the slots 58, 60 (see also FIG. 4 and FIG. 5), the vane member 20 cannot move in a direction perpendicular to the vanes of the orientation of FIG. 6*a* without rotation. Therefore the vane member 20 and the rotor 30 are forced to rotate about 45° together as indicated by the indicators 12, 13 according to FIG. 6*b*. Thus, the vacuum pump 1 is moved from the first rotational position P1 (see FIG. 6*a*) to an intermediate position PI (see FIG. 6*b*).

When the central shaft 40 rotates further to a 180° position (see FIG. 6*c*), the indicator I1 directs to the twelve o'clock position and the point of action of the vane member 20 which is again identical to the central axis AE of the eccentric element 42, is further rotated about the rotational axis AS of the central shaft 40 and thus both, the vane member 20 and the rotor 30 are rotated about 90° so that the indicators 12, 13 direct to the 9 o'clock-position. The vacuum pump 1 is now in a second rotational position P2.

Figure 6A:
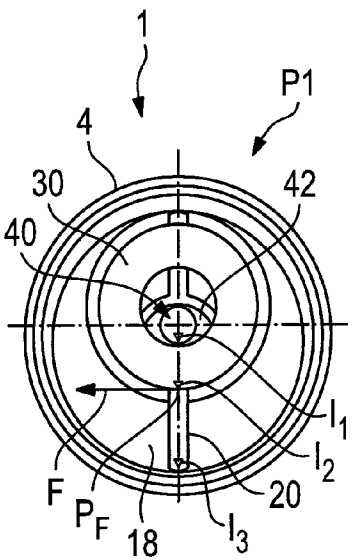

As can be seen when comparing FIG. 6*a* and FIG. 6*c* the radially outermost point of the eccentric element 42 relative to the central shaft 40 is located in the first rotational position P1 on a longitudinal plane of the vane member 20 and in the second rotational position P2 distal from the longitudinal plane of the vane member 20. In the first rotational position P1 only one tip of the vane member 20 projects out of the rotor 30 and in the second rotational position P2 both tips project substantially the same distance from the rotor 30.

Further, the direction of the driving force F at the point of force application is in the first rotational position P1 substantially perpendicular to the plane of the vane member 20 and in the second rotational position P2 substantially parallel to the plane of the vane member 20.

Finally, when the central shaft 40 has rotated a full 360° rotation (see FIG. 6*d*) the vane member 20 and the rotor 30 have rotated a half rotation about 180°, as indicated by the indicators I1, I2, I3 in FIG. 6*d*. The vacuum pump now is in a third position P3 and again only one tip of the vane member 20 projects out of the rotor 30. Thus, the vacuum pump 1 of the present invention incorporates a transmission between the rotation of the central shaft 40 and the vane member 20. The vane member 20 always rotates half the rotational angle of the central shaft 40 and thus also at half speed. This is due to the eccentric element 42 and the offset between the eccentric element 42 and thus the offset between the point of action of the vane member 20, the central shaft 40 and the rotor 30. In rotation, the vane member 20 is rotated relative to the central shaft 40 and the central hollow jacket 21 of the vane member 20 slides on the outer surface of the eccentric element 42. Therefore, a kind of a friction bearing is provided between the eccentric element 42 and the central hollow jacket 21 of the vane member 20.

Figure 7:
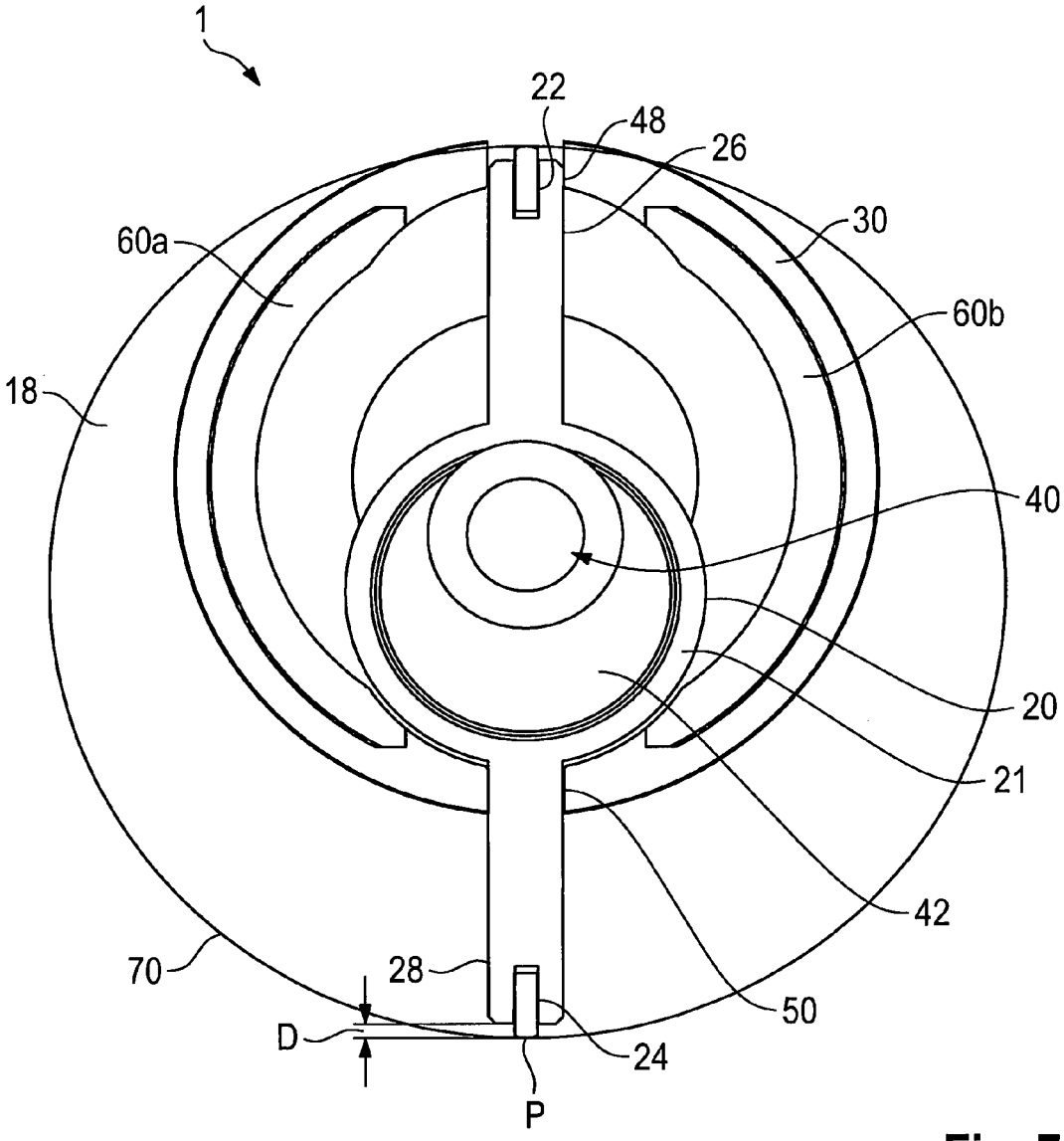
FIG. 7 shows a top view of another embodiment of a vacuum pump according to the present invention.
Figure 8:
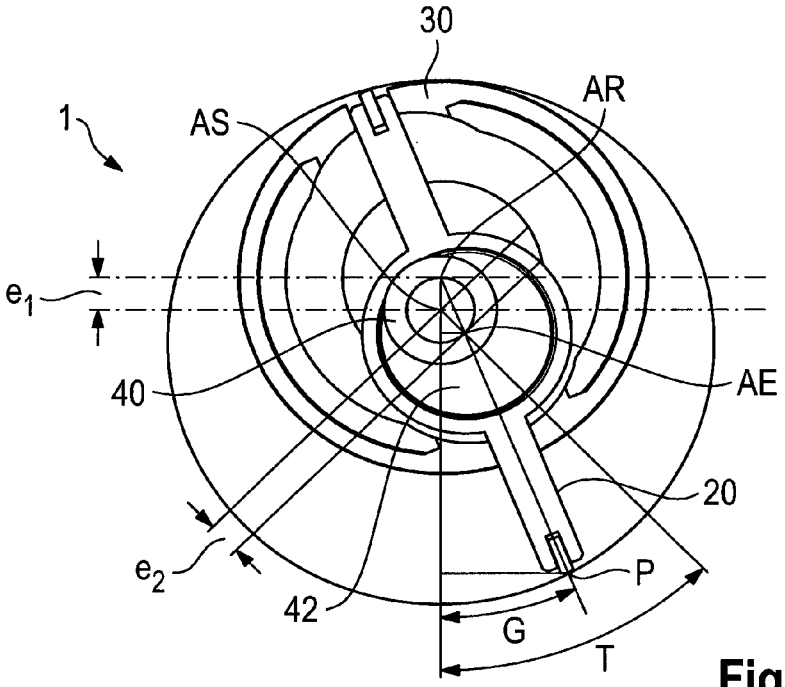
FIG. 8 shows a top view of the vacuum pump according to FIG. 7 in a different rotational positions with geometrical properties indicated at the parts.
Figure 9:
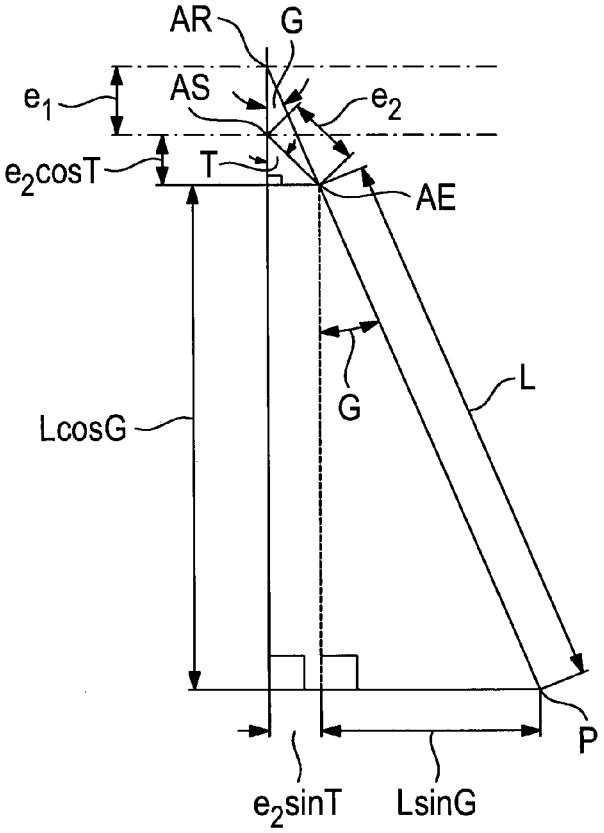
FIG. 9 shows a diagram illustrating the geometrical relationship between the moving parts according to an embodiment of the invention.

Now with reference to FIG. 7 to FIG. 9 the geometrical properties of the vacuum pump 1 are explained in more detail. Reference is made to the elevated view of the vacuum pump 1 depicted in FIG. 7. According to the elevated bottom view in FIG. 7 the housing 4 is left away and a free view on the rotor 30 the central shaft 40 having the eccentric elements 42 and the vane member 20 is shown from the bottom, hence from the drive motor 2 as shown in FIG. 1. According to this embodiment the rotor 30 includes a lower bearing journal 60*a*, 60*a* which is formed as two rims, which protrude from the lower end of the rotor 30 and are generally in form of segments of a circle. The vane member 20 includes a central hollow jacket 21 used for seating the vane member 20 about the eccentric element 42 formed on the central shaft 40 and two vanes 26, 28 protruding from the central hollow jacket 21. Both vanes 26, 28 are provided with sealing means 22, 24 and are coupled to the rotor 30 by means of the slots 48, 50 in the rotor through which they extend. In FIG. 7 the housing 4 is not shown as well as the inner circumferential wall 19. Only the cavity 18 can be derived from FIG. 7. With reference sign 70 the orbital contour is shown which is generated by the vane member 20 in rotation via the sealing means 22, 24. This contour 70 is in shape of a conchoid. In general the vacuum pump 1 shown in FIG. 7 is at the six o'clock-position similar as shown in FIG. 4, FIG. 2 and FIG. 6*a*.

In FIG. 8 the same vacuum pump 1 is shown however the vane member 20 and the rotor 30 are slightly turned in a counterclockwise direction about the angle G. Additionally some reference signs which have been depicted in FIG. 7 are omitted in FIG. 8 for the sake of clearness. However the three axes, the rotational axis AR of the rotor 30, the rotational axis AS of the central shaft 40 and the central axis AE of the eccentric element 42 which is at the same time is the point of action of the vane member 20 are indicated. Further indicated is the eccentric offset e1 between the rotational axis AR of the rotor 30 and the rotational axis AS of the central shaft 40 as well as the eccentric offset e2 between the rotational axis AS of the central shaft 40 and the central axis AE of the eccentric element 42. Further indicated is angle G which is the measure between the six o'clock-position as shown in FIG. 7 and the rotated position of the vane member 20 and the rotor 30 as shown in FIG. 8, and angle T, which is the respective rotational position of the central shaft 40. With L is the theoretical length one vane indicated, thus the length between the point of action of the vane member 20 (i.e. the central axis AE of the eccentric element 42) and the tip P of the sealing means 24 (see FIG. 7).

FIG. 9 illustrates the geometrical relationships as indicated in FIG. 8 in a diagram. Indicated are the angles G and T as well as the eccentric offsets e1, e2 in accordance with the rotational position as indicated in FIG. 8. The further geometrical properties are shown with reference to the angles G and T.

The mathematical relationship derivable from FIG. 8 and FIG. 9 is as follows:

$$\tan G = \frac{e \sin T}{e + e \cos T} \quad (1)$$

$$\tan G = \frac{\sin T}{1 + \cos T} \quad (2)$$

$$\frac{\sin G}{\cos G} = \frac{\sin T}{1 + \cos T} \quad (3)$$

-continued $$\sin G \cdot [1 + \cos T] = \sin T \cdot \cos G \quad [4]$$

$$\sin G + \sin G \cdot \cos T = \sin T \cdot \cos G \quad [5]$$

$$\sin G = \sin T \cdot \cos G - \sin G \cdot \cos T \quad [6]$$

The following is a trigonometric identity:

$$\sin(u-v)=\sin u \cdot \cos v - \cos u \cdot \sin v \quad [7]$$

For u=T and G=V the identity is:

$$\sin(T-G)=\sin T \cdot \cos G - \cos T \cdot \sin G \quad [8]$$

From [6] and [8]

$$\sin G=\sin(T-G) \quad [9]$$

The function sin is periodic, repeating every 2π. The first solution will be when $$G = T - G \quad [10]$$

$$2G = T \quad [11]$$

$$G = \frac{T}{2} \quad [12]$$

This is significant because it means that the rotor angle G is always half the eccentric angle.

Figure 10:
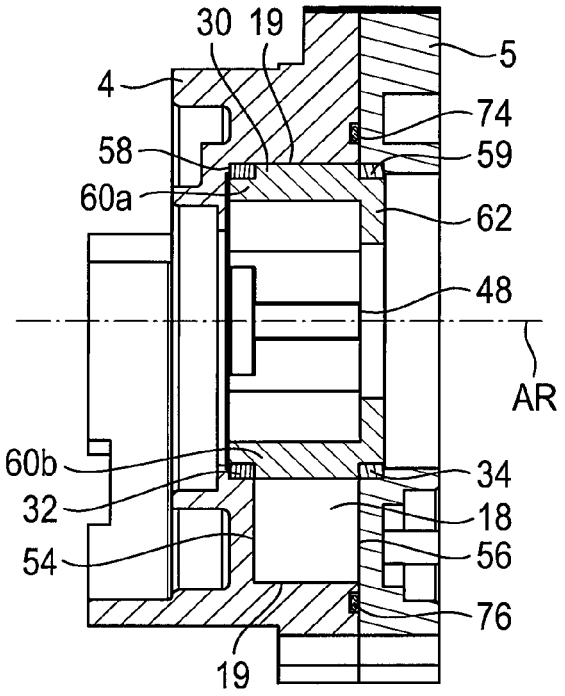
FIG. 10 shows a cross-sectional view through the cavity and the rotor without the vane member according to an embodiment of the invention.
Figure 11:
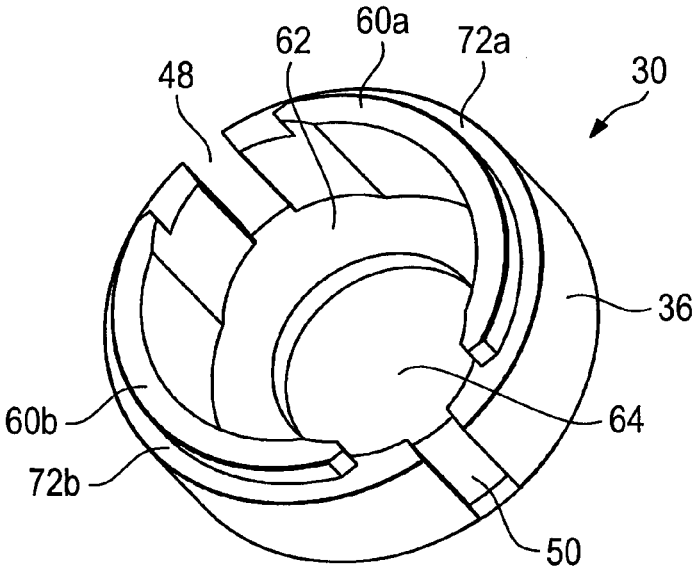
FIG. 11 shows a perspective view of the rotor according to an embodiment of the invention.

With further reference to FIG. 10 and FIG. 11 the rotor 30 is described in greater detail. The rotor 30 comprises a substantially cylindrical wall 36 having two opposed slots 48, 50 for guiding the vane member 20 (see also FIG. 4 and FIG. 7). According to FIG. 10 the rotor 30 is cut along a plane perpendicular to the plane of the two slots 48, 50, so that the slot 48 is visible in FIG. 10. The rotor 30 is seated inside the cavity 18 and in one point, according to FIG. 10 the upper most point, in contact with the inner circumferential wall 19 of the cavity 18. The rotor 30 further comprises a first bearing journal 60 formed as two rims 60*a*, 60*b* protruding from a bottom portion of the wall 36 of the rotor 30 in an axial direction and substantially formed as ring segments. The bearing journal 60*a*, 60*b* is adapted to engage with a recessed portion 58 in the bottom plate 54 of the cavity 18, formed integral with the housing 4. Inside the recessed portion 58 a bearing 32 is arranged for engagements with the bearing journal 60*a*, 60*b*. The bearing 32 is formed as a PEEK ring having a rectangular cross section so as to fit into the edge 72*a*, 72*b* defined between the rotor wall 36 and the bearing journals 60*a*, 60*b*.

The second bearing journal 62 is generally formed as a ring shaped plate extending from the rotor wall 36 at the opposite side of the first bearing journal 60*a*, 60*b*. The second bearing journal 62 is adapted to engage a recessed portion 59 formed in the cover 5 which defines the end plate 56. Between the cover 5 and the housing 4 an O-ring 74 is arranged in a groove 76 formed in the housing 4 for sealing the cover 5 against the housing 4. The second bearing journal 62 engages a bearing 34 which is formed as a PEEK ring having a substantially rectangular cross section. Due to the fact that the second bearing journal 62 is formed as a ring shaped plate having the through hole 64, the bearing journal 62 is permanently in contact with the bearing 34 which is also continuous without any gaps grooves or the like thus serving at the same time as a sealing for the rotor 30 against the housing 4 and the cover 5.

Now FIG. 12 to FIG. 17 illustrate different embodiments of sealing means for vane member 20. According to FIG. 12 a vane member 20 is shown having a central hollow jacket 21 and two vanes 26, 28 protruding from opposed sides of the central hollow jacket 21. Two sealing means 22, 24 are shown in an exploded view detached from the respective vanes 26, 28. The vanes 26, 28 include a groove 78, 80 which extends along three sides 26*a*, 26*b*, 26*c*, 28*a*, 28*b*, 28*c* of the vanes 26, 28. The sealing means 22, 24 are generally U-shaped and adapted to be seated into the groove 78, 80 for engagements with the vanes 26, 28. The outer most sides 26*b*, 28*b* form the vane tips which are moving in close relationship with the inner circumferential wall 19 of the cavity 18.

Figure 13:
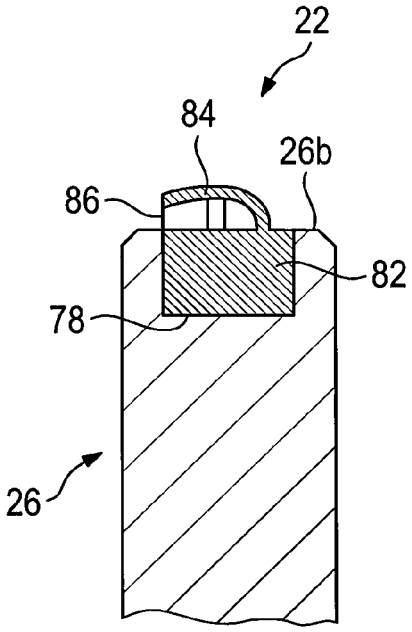
FIG. 13 shows a cross-sectional detail view of a vane tip with a seal according to an embodiment of the invention.

FIG. 13 shows a cross sectional view of a vane tip and a sealing means 22 in a cross sectional cut. The sealing means 22 according to this embodiment is formed as a pressure deforming seal having a body 82 and a lip 84 which extends from the body 82. The body is adapted to be seated inside the groove 78 and substantially fills the whole groove 78 to align with the surface of the vane 26, 28. The lip 84 is flexible and extends from the body 82 first into radial direction away from the central hollow jacket 21 and then bent to one side, namely into the direction of movement of the vane member 20. Therefore the lip 84 defines a cavity 86 between the lip 84 and the body 82 into which a fluid inside the cavity 18 can be introduced during rotation of the vane member 20 and thus, when for example on the left hand side of FIG. 13 the pressure is higher than the right hand side of FIG. 13, the lip 84 is pressed against the inner circumferential wall 19 of the cavity 18 thus increasing the sealing effectivity.

Figure 12:
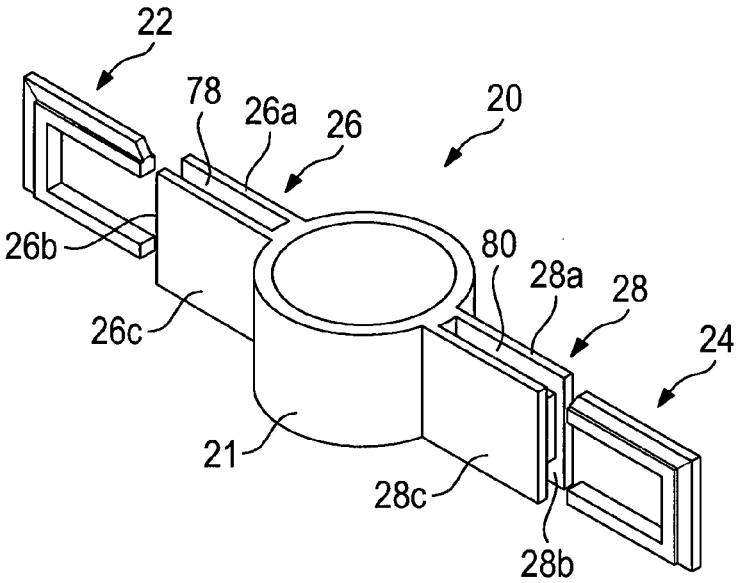
FIG. 12 shows a perspective view of a vane member in exploded view with a seal according to an embodiment of the invention.
Figure 14:
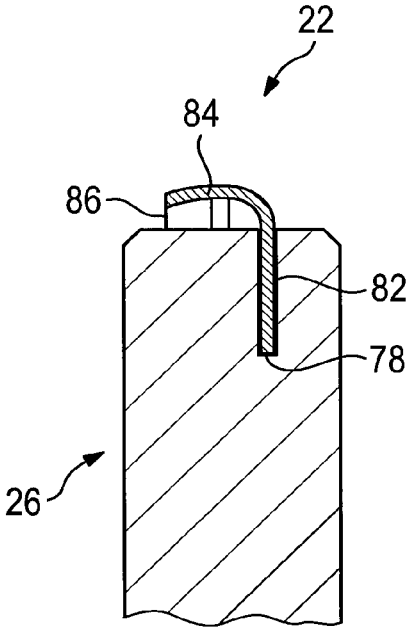
FIG. 14 shows a cross-sectional detail view of a vane tip with a second seal variant according to an embodiment of the invention.
Figure 15:
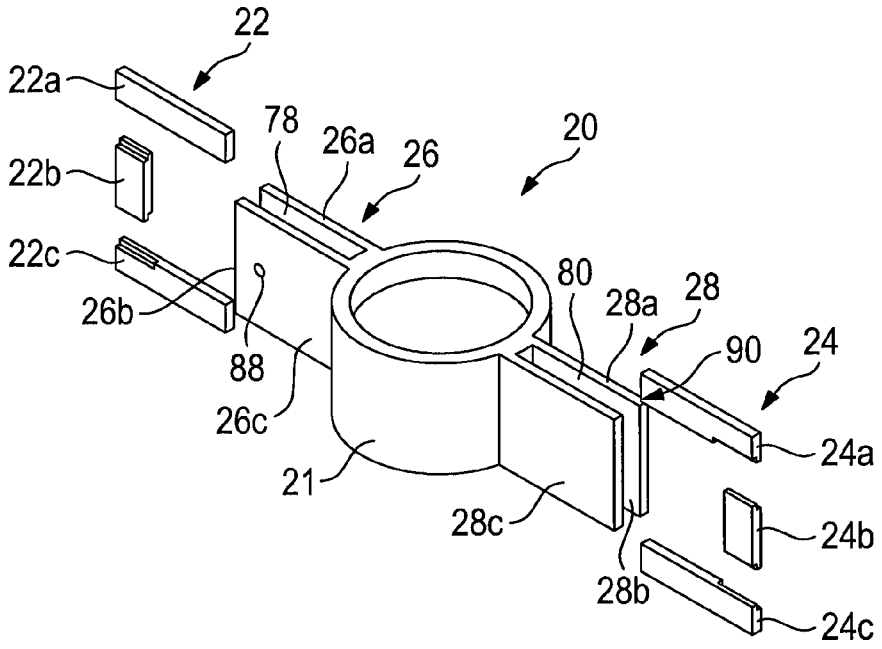
FIG. 15 shows a perspective view of a vane member with an exploded view of a seal according to an embodiment of the invention.
Figure 16:
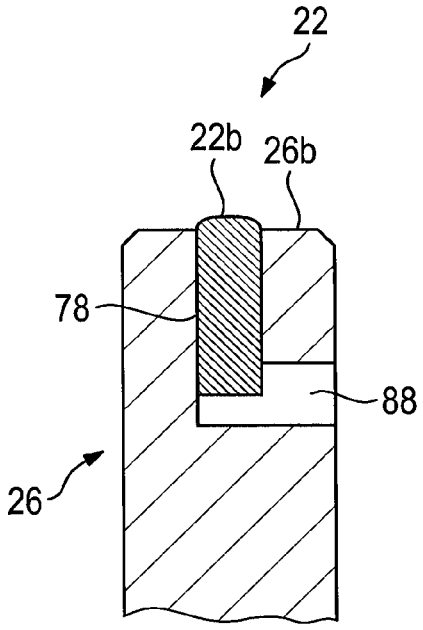
FIG. 16 shows a detailed cross-sectional view of a vane tip according to a force embodiment with a seal.
Figure 17:
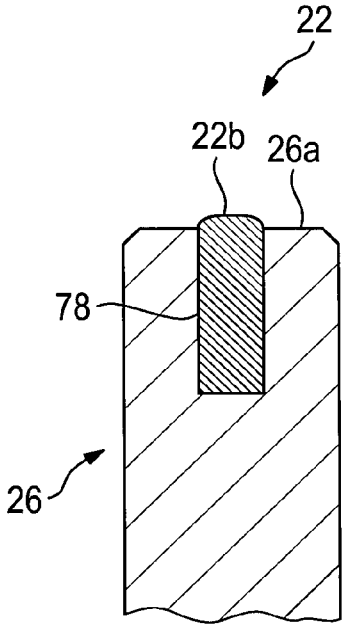
FIG. 17 shows a detailed cross-sectional view of a vane tip with a seal in a force embodiment.

FIG. 14 shows an alternative arrangement of a pressure deforming seal. Identical and similar parts are depicted with identical reference signs of FIG. 13 and insofar reference is made to the description of FIG. 13. In contrast to the pressure deforming seal of FIG. 13, the pressure deforming seal 22 of FIG. 14 has a body 82 which has the same thickness as the lip 84. The body 82 is seated in a groove 78, which according to this embodiment (FIG. 14) is formed as a slot. The sealing means 22 according to FIG. 14 has the advantage that it is simpler to manufacture however it may be more difficult to seat the sealing means 22 inside the slots 78 than inside the groove 78 as shown in FIG. 13 which has an increased width.

Wherein the sealing means 22 according to FIG. 12, FIG. 13 and FIG. 14 are each formed as one single part, the sealing means 22, 24 according to FIG. 15 to FIG. 17 are formed as separate parts. FIG. 15 again shows a vane member 20 having a central hollow jacket 21 and two vanes 26, 28. Again identical and similar parts are depicted with identical reference signs and insofar reference is made to FIG. 12 to FIG. 14 and the above description relating to these FIGs.

Each vane 26, 28 again comprises a groove 78, 80 which is running along the three side 26*a*, 26*b*, 26*c* and 28*a*, 28*b*, 28*c*. The sealing means 22, 24 each are comprised of three elements 22*a*, 22*b*, 22*c*, 24*a*, 24*b*, 24*c* which are adapted to engage the groove 78, 80. In difference to the above sealing arrangement (see FIG. 12 to FIG. 14) FIG. 15 and FIG. 16 depict a pressure activated seal. Therefore the groove 78 is connected with a pressure gallery 88 and the groove 80 is connected with a pressure gallery 90. This means, that between each segment of the sealing means 22 namely the segment 22*a*, 22*b*, 22*c* and the segments 24*a*, 24*b*, 24*c* and the bottom of the groove 78, 80 a cavity is formed which is connected to the side face of the vane 26, 28 as depicted with the pressure gallery 88 in FIG. 15 and FIG. 16. Thus, when the pressure for example on the right hand side of FIG. 16 is higher than on the left hand side of FIG. 16, fluid is introduced into the pressure gallery 88 and forces the segments 22*b* to move out of the groove 78 in a radial direction of the vane 26 and to engage the inner circumferential wall 19 of the cavity 18 thus leading to an enhanced sealing of the vanes 26, 28 against the cavity wall 19 and the bottom and end plate 54, 56. Therefore it is also advantageously that the sealing means 22, 24 according to such an embodiment is comprised of the three segments 22*a*, 22*b*, 22*c*, 24*a*, 24*b*, 24*c* so that each segment can move independently from each other to engage the respective cavity wall 19, 54, 56.

In FIG. 17 as a further alternative a static seal is shown. The seal 22 according to FIG. 17 comprises a tip segment 22*b* which is arranged inside a groove 78 at the vane tip 26*b*. The segment 22*b* may be fixed inside the groove by means of adhering or by means of a tight fit.

Figure 18:
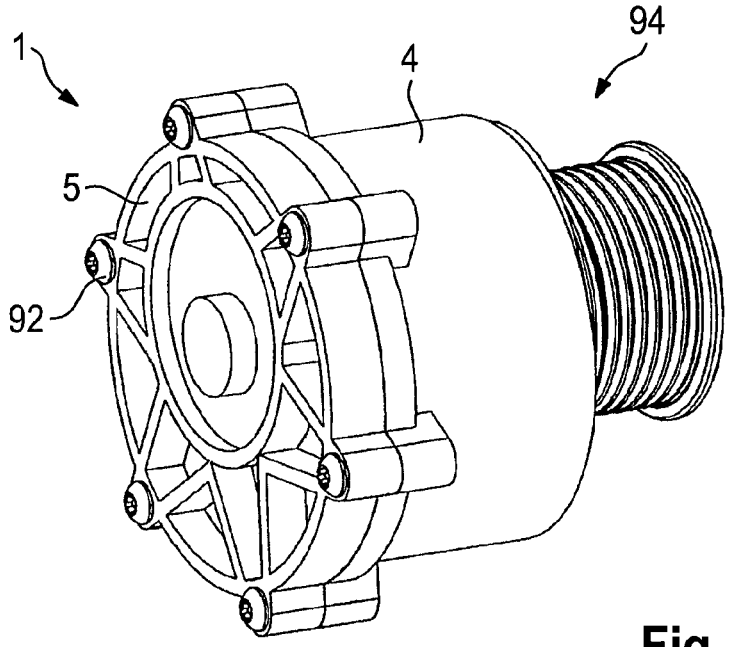
FIG. 18 shows a perspective view of a vacuum pump according to a further embodiment of the present invention.
Figure 19:
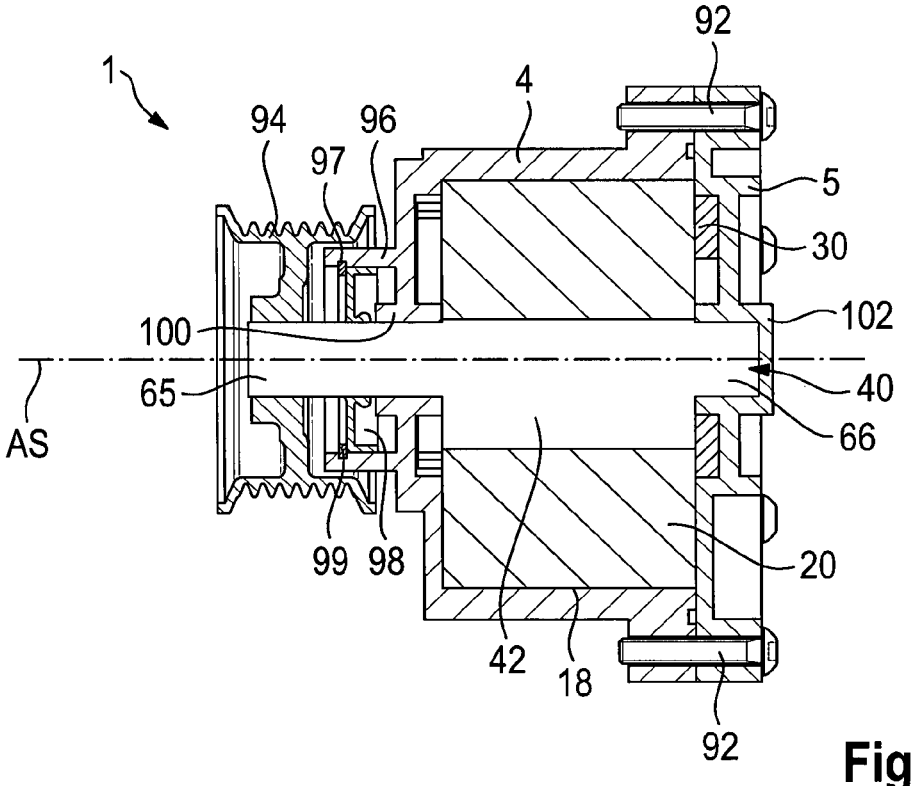
FIG. 19 shows a cross-sectional view of the vacuum pump according to FIG. 18.
Figure 20:
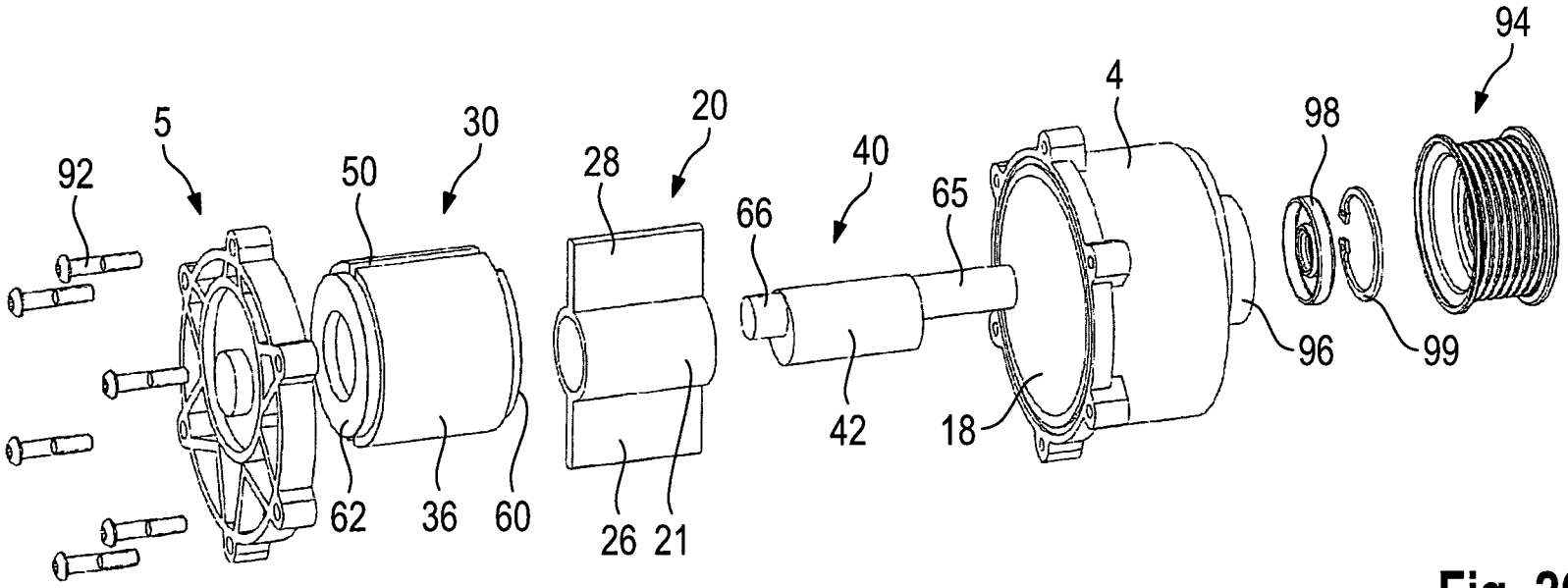
FIG. 20 shows an exploded view of the vacuum pump according to FIG. 18 and FIG. 19.

Finally FIG. 18 to FIG. 20 illustrate a further general embodiment of the vacuum pump 1 which according to this embodiment is not connected to electric drive motor 2. The vacuum pump 1 of FIG. 18, FIG. 19 and FIG. 20 includes a housing 4 as well as the vacuum pump 1 for example shown in FIG. 1. Further the vacuum pump 1 includes a cover 5 which is fixed to the housing 4 by means of screws 92 and closes the cavity 18 inside the housing 4. Inside the cavity 18 a rotor 30 a vane member 20 and a central shaft 40 are provided, the central shaft 40 having an eccentric element 42 as described with reference to FIG. 1 to FIG. 9 in a greater detail.

Different from the first embodiments, the central shaft 40 includes a bottom end shaft 65 which projects out of the housing 4. On the bottom end shaft 65 a pulley 94 is fixed for transmitting a drive force from a belt drive to the central shaft 40. The central shaft 40 according to this embodiment therefore acts as a drive shaft. At an end portion 96 of the housing 4 which is in form of a collar on the opposite side of the cavity 18 the end shaft portion 65 is additionally sealed by means of a radial shaft seal 98. The radial shaft seal 98 is hold in place by means of an inner snap ring 99 engaging an inner groove 97 in the collar 96. The portion of the housing 4 which is arranged between the collar 96 and the cavity 18 forms a friction bearing 100 for the central shaft 40. In the same manner, a top portion 66 of the shaft (see also FIG. 5) is received in the cover 5 in a respective friction bearing 102. Therefore the central shaft 40 is received in two bearings 100, 102 on opposing sides of the eccentric elements 42.

FIG. 20 illustrates the assembly of the vacuum pump 1 according to FIGS. 18 and 19. Reference is also made to the above description of FIG. 3; in FIG. 20 identical and similar parts are depicted with identical reference signs and insofar reference is made to the above description of FIG. 3 as well.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCES

1 vacuum pump
2 drive rotor
4 housing of the vacuum pump
5 cover
6 housing of the motor
8 rotor
10 drive shaft
12 connection portion
14 frame
15 electrical connection
18 cavity
19 inner circumferential wall
20 vane member
21 central hollow jacket
22 sealing means (of the first vane)
22A,B,C sealing segments (of the first vane)
24 sealing means (of the second vane)
24A,B,C sealing segments (of the second vane)
26 first vane
26A,B,C upper and lower sides of first vane and first vane tip
28 second vane
28A,B,C upper and lower sides of second vane and second vane tip
30 rotor
32 bearing
34 bearing
35 counter weight
36 rotor wall
38 inner space of rotor
40 central shaft
41A first axial position on the central shaft
41B second axial position on the central shaft
42 eccentric element
43 radially outermost point of the eccentric element
44 first working chamber (suction side)
46 second working chamber (pressure side)
48 slot in rotor
50 slot rotor
52 opening
54 bottom plate
56 end plate
58 recessed portion (of the housing side)
59 recessed portion (of the cover side)
60 first bearing journal
60*a, b* rims forming bearing journal
62 second bearing journal

65 bottom portion of shaft
66 end portion of shaft
68 bearing
70 orbital contour
72*a, b* edge
74 O-ring
76 groove in housing for O-ring
78 first groove at edge of first vane
80 second groove at edge of second vane
82 body
84 lip
86 cavity
88 first pressure gallery in first vane
90 second pressure gallery in second vane
92 screw
94 pulley
96 end portion
97 inner groove
98 radial shaft seal
99 snap ring
100 friction bearing
102 friction bearing
D distance between vane tips and inner wall of cavity
e1 eccentric offset between AS/AR
e2 eccentric offset between AS/AE
F force
G angle
I1, I2, I3 indicators
L theoretical length
P tip
T angle
P1 first position
PI intermediate position
P2 second position
P3 third position

The invention claimed is:

1. A rotating vane vacuum pump, comprising
a housing defining a cavity having an inlet and an outlet;
a drivable vane member for a rotary driven movement inside the cavity;
a rotor inside the cavity; and
a rotatable central shaft extending into the cavity;
wherein the vane member is coupled to the central shaft by an eccentric element on the central shaft and movably arranged in the rotor, the rotor being rotatable together with said vane member upon rotation of the vane member,
wherein a rotational axis of the central shaft is offset from a rotational axis of the rotor and a point of action of the vane member is offset from the rotational axis of the central shaft by the eccentric element on the central shaft, and
wherein the rotor encloses radially the eccentric element of the central shaft.

2. The vacuum pump according to claim 1, wherein the rotor comprises an outer wall and defines an inner space, and
wherein the eccentric element of the central shaft moves back and forth in a radial direction of the rotor when the central shaft is in rotation.

3. The vacuum pump according to claim 2, wherein the inner space of the rotor has an inner diameter which is at least twice a maximum offset of the central axis of the eccentric element and the rotational axis of the rotor.

4. The vacuum pump according to claim 2, wherein the outer wall of the rotor comprises first and second slots in first and second opposing positions on a radial direction, and wherein the first and second slots are configured to allow the vane member to slide in the radial direction of the rotor when at least one of the central shaft or the rotor is in rotation.

5. The vacuum pump according to claim 1, wherein the central shaft, the rotor, and the vane member are positively coupled together.

6. The vacuum pump according to claim 1, wherein the central shaft rotates twice a rotational angle of the vane member and the rotor.

7. The vacuum pump according to claim 1, wherein a radially outermost point of the eccentric element relative to the central shaft is located:
in a first rotational position on a longitudinal plane of the vane member; and
in a second rotational position distal from the longitudinal plane of the vane member;
wherein in the first rotational position only one tip of the vane member projects out of the rotor and in the second rotational position both tips project the same distance from the rotor.

8. The vacuum pump according to claim 7, wherein a direction of a driving force at a point of force application is:
in the first rotational position perpendicular to the plane of the vane member; and
in the second rotational position parallel to the plane of the vane member.

9. The vacuum pump according to claim 1, wherein the eccentric element is formed as a cam on the central shaft, and
wherein the vane member comprises a central hollow jacket and is seated about the cam by the jacket.

10. The vacuum pump according to claim 9, wherein the vane member is formed as a single one-piece vane member having first and second vanes on the hollow jacket protruding in a radial direction on opposing sides of the jacket.

11. The vacuum pump according to claim 9, wherein the cam extends along the central shaft from a first axial position to a second axial position, and
wherein both of the first and second positions are located within the cavity.

12. The vacuum pump according to claim 1, wherein the central shaft extends through the rotor and through the cavity such that end portions of the central shaft project from opposing sides of the rotor and of the cavity.

13. The vacuum pump according to claim 1, wherein an offset of the rotational axis of the central shaft relative to the rotational axis of the rotor is equal to an offset of the point of action of the vane member relative to the rotational axis of the central shaft.

14. The vacuum pump according to claim 1, wherein the rotor comprises at least one bearing journal for bearing the rotor against at least one of a bottom plate or an end plate of the cavity.

15. The vacuum pump according to claim 14, wherein the bearing journal is received in a bearing in the bottom plate and/or the end plate.

16. The vacuum pump according to claim 1, wherein first and second tips of first and second vanes at first and second ends of the vane member are moved with a distance remaining between the tip and an inner circumferential wall of the cavity along the inner circumferential wall of the cavity.

17. The vacuum pump according to claim 1, wherein the rotor is sealed in a fluid tight manner against at least one of a bottom plate or an end plate of the cavity.

18. The vacuum pump according to claim 1, wherein at least one of vane member tips or first and second side portions of the vane member comprise seals for sealing the vane member against the cavity.

19. The vacuum pump according to claim 18, wherein the seals are at least arranged at three sides of the vane member and comprise a pressure deforming seal having a lip in contact with a cavity wall and bent into the direction of rotation of the vane member.

20. The vacuum pump according to claim 1, wherein the central shaft is a drive shaft and coupled to a driving motor for driving the vacuum pump.

21. The vacuum pump according to claim 1, wherein the rotor is a drive rotor and coupled to a driving motor for driving the vacuum pump.

* * * * *